US011445814B2

(12) United States Patent
Rees

(10) Patent No.: US 11,445,814 B2
(45) Date of Patent: Sep. 20, 2022

(54) SHEARING DEVICE AND BRUSH PRODUCTION MACHINE WITH SHEARING DEVICE, AND USE OF A SHEARING DEVICE

(71) Applicant: Zahoransky AG, Todtnau (DE)

(72) Inventor: Thomas Rees, Todtnau (DE)

(73) Assignee: Zahoransky AG, Todtnau (DE)

( * ) Notice: Subject to any disclaimer, the term of this patent is extended or adjusted under 35 U.S.C. 154(b) by 142 days.

(21) Appl. No.: 16/807,508

(22) Filed: Mar. 3, 2020

(65) Prior Publication Data

US 2020/0281348 A1 Sep. 10, 2020

(30) Foreign Application Priority Data

Mar. 7, 2019 (DE) ..... 102019105877.5

(51) Int. Cl.

| | |
|---|---|
| ***A46D 9/02*** | (2006.01) |
| ***B26D 1/36*** | (2006.01) |
| ***B26D 1/38*** | (2006.01) |
| ***B26D 7/26*** | (2006.01) |

(52) U.S. Cl.

CPC ..... *A46D 9/025* (2013.01); *B26D 1/365* (2013.01); *B26D 1/385* (2013.01); *B26D 7/2628* (2013.01); *B26D 2007/2657* (2013.01)

(58) Field of Classification Search

CPC .. B26D 1/38; B26D 2001/006; B26D 7/0666; B26D 1/03; B26D 1/365; B26D 1/385; B26D 7/2628; B26D 2007/2657; A46D 1/06; A46D 9/025; A46D 9/02; Y10T 83/4847; Y10T 83/4827; Y10T 83/9394; Y10T 83/913; Y10T 83/263; D06C 13/00

See application file for complete search history.

(56) References Cited

U.S. PATENT DOCUMENTS 1,433,474 A * 10/1922 Poetzsch ..... D06C 13/00 26/16
2,183,722 A * 12/1939 Newman ..... B26F 1/00 83/345
2,234,105 A * 3/1941 Ashton ..... D01G 1/04 83/342

(Continued)

FOREIGN PATENT DOCUMENTS

DE 2404837 8/1977
DE 3941738 6/1991

(Continued)

*Primary Examiner* — Jonathan G Riley
(74) *Attorney, Agent, or Firm* — Volpe Koenig

(57) ABSTRACT

A shearing device (1) having a blade (2) with at least one blade cutting edge (5) which is helically coiled, and rotatable, about an axis of rotation (R) of the blade (2). The blade cutting edge (5) is assigned a counterpart blade cutting edge (4) of a counterpart blade (3). The shearing movements, by which for example bristle filaments (7) of brushes (8) for machining can be cut to length, are generated by relative rotational movement of the at least one helically coiled blade cutting edge (5) with respect to the preferably static counterpart blade cutting edge (4) of the counterpart blade (3). Since the blade (2) and the counterpart blade (3) can keep their spacing to one another constant during operation, there is a relatively low risk of injury during the use thereof.

24 Claims, 11 Drawing Sheets

(56) References Cited

U.S. PATENT DOCUMENTS 2,360,228 A * 10/1944 Hogue ..... D06C 13/00 26/15 R
2,732,608 A * 1/1956 Richardson ..... D06C 13/00 26/15 R
3,135,151 A * 6/1964 Link ..... B08B 15/04 83/168
3,304,821 A * 2/1967 Matino ..... D01G 1/04 83/26
3,325,845 A * 6/1967 Sawkiw ..... A46D 1/0292 15/207.2
3,478,392 A * 11/1969 Gorrafa ..... D01G 1/04 19/0.62
3,633,831 A * 1/1972 Dodson ..... B26D 1/38 241/61
3,776,084 A * 12/1973 Slyvakov ..... D01G 1/04 83/342
5,359,915 A * 11/1994 Hitz ..... B26D 1/385 83/342
5,435,217 A * 7/1995 Kato ..... B26D 1/205 83/100
5,446,950 A * 9/1995 Shibata ..... D06C 13/00 26/15 R
5,472,263 A * 12/1995 Gerspacher ..... A46B 9/04 300/17
5,697,282 A * 12/1997 Schakel ..... B23D 35/008 83/100
6,372,163 B1 * 4/2002 Boucherie ..... A46D 9/02 264/68
6,837,548 B2 * 1/2005 Boucherie ..... A46D 9/02 300/17
8,528,141 B2 * 9/2013 Montabaur ..... A46B 17/00 15/22.1
8,806,999 B2 * 8/2014 Tanaka ..... B25J 11/006 83/162
2003/0001427 A1 * 1/2003 Lanvers ..... A46D 9/02 300/2
2010/0043610 A1 * 2/2010 Tanaka ..... B26F 1/3806 83/22
2013/0047805 A1 * 2/2013 Nootbaar ..... A46D 9/02 83/13
2015/0075347 A1 * 3/2015 Nootbaar ..... B26D 1/0006 83/694
2015/0202791 A1 * 7/2015 Liu ..... B27C 1/14 144/225
2017/0251796 A1 * 9/2017 Nakamura ..... A46B 15/00

FOREIGN PATENT DOCUMENTS

DE 19509063 9/1996
DE 19528834 2/1997
DE 102012018636 12/2013
DE 102012018636 B3 * 12/2013 ..... D06C 13/00
DE 102017110231 11/2018

* cited by examiner

SHEARING DEVICE AND BRUSH PRODUCTION MACHINE WITH SHEARING DEVICE, AND USE OF A SHEARING DEVICE

INCORPORATION BY REFERENCE

The following documents are incorporated herein by reference as if fully set forth: German Patent Application No. 10 2019 105 877.5, filed Mar. 7, 2019.

TECHNICAL FIELD

The invention relates to a shearing device having a blade and having a counterpart blade assigned to the blade, a brush production machine having a shearing device of said type, and the use of a shearing device for cutting bristle filaments to length.

BACKGROUND

In the production of brushes, it is often necessary for bristle filaments to be shortened or cut into shape. In particular in the case of the machining of brush bodies that have already been equipped with bristles, shearing devices with fly cutters are often used in practice. Shearing devices with fly cutters are already known for example from the documents DE 39 41 738 A1, DE 195 09 063 A1 and DE 195 28 834 B4.

The document DE 10 2012 018 636 B3 has already disclosed a shearing machine for shearing textile material for shearing. The shearing machine has a band knife with a cutting edge which faces toward a shearing cylinder of the shearing machine during the shearing process. Here, the band knife passes from a master cassette and, after use, is wound up again in a slave cassette.

The document DE 10 2017 110 231 A1 has already disclosed a cutting device for processing textiles. The cutting device has an elongate cylinder body which is mounted such that it can be driven about an axis of rotation. On the cylinder body, there is fastened an elongate blade of helical form. Furthermore, the cutting device has an elongate counterpart blade, the longitudinal axis of which extends parallel to the axis of rotation of the cylinder body.

The document DE 24 04 837 C3 has furthermore already disclosed a shearing spiral for a revolving shearing cylinder. For the purposes of shearing fibrous web, the shearing cylinder interacts with a static, straight counterpart blade which is arranged parallel to the cylinder axis.

Although the use of fly cutters is basically well proven, it is associated with relatively high levels of noise generation, which is perceived as disturbing and which can therefore necessitate noise protection measures. Owing to the fly cutter which moves at high speed during operation and also during the setup of the shearing devices, it is furthermore necessary for the user to exercise increased caution in order to avoid injuries. For reasons of working safety, it is necessary to define and comply with safety measures for the operation of the shearing devices and to equip the shearing devices with corresponding protection means in order to minimize a risk of injury during the setup and operation of the shearing devices. The known shearing devices therefore require a safety-oriented and relatively cumbersome construction even of the peripheral equipment of the shearing devices, in order to adequately allow for the particular risk associated with the use of fly cutters. Particular caution must be exercised in particular during the setup of these shearing devices, because it is here that the technician performing the setup must also perform handling operations in the working region of the shearing devices, in which the fly cutters move. This can make the manipulation of the previously known shearing devices more difficult.

SUMMARY

It is therefore an object of the invention to provide a shearing device, a brush production machine and a use of a shearing device of the type mentioned in the introduction, with which the above-stated disadvantages can be reduced or eliminated entirely.

To achieve said object, a shearing device is firstly provided, which has one or more features of the invention that are directed to a shearing device of this type. Accordingly, to achieve the object, there is provided, in particular, a shearing device having a blade and having a counterpart blade assigned to the blade, wherein the blade, in order to generate a cutting movement relative to a counterpart blade cutting edge of the counterpart blade, is rotatable about an axis of rotation and has at least one blade cutting edge which is helically coiled about its axis of rotation. The rotation of the blade about its axis of rotation has the effect that the blade cutting edge, which is helically coiled about the axis of rotation, also moves relative to the counterpart blade cutting edge of the blade. Here, a relative cutting movement between the blade cutting edge and the counterpart blade cutting edge is generated, by which, for example, bristle filaments can be shortened. With this cutting concept of the shearing device, fly cutters are avoided, by which bristle filaments are literally hacked off. The shearing device according to the invention permits a continuous and flowing cutting movement, which can lead not only to improved cutting results but also to a higher level of working safety during the operation of the shearing device.

It is preferable if the at least one helically coiled blade cutting edge runs all the way around the axis of rotation of the blade at least once, preferably multiple times. This promotes the greatest possible cutting edge length of the blade cutting edge and can contribute to a fine, precise cut.

The shearing device can satisfy particularly high safety demands, while at the same time providing a particularly high-quality cutting pattern, if the blade cutting edges and the counterpart blade cutting edges of the shearing device have a spacing of between 0 mm and 0.5 mm, preferably between 0 mm and 0.1 mm, to one another. In this way, the spacing between the blade cutting edge and the counterpart blade cutting edge is in any case so small that it is impossible to inadvertently place one's fingers between the blade cutting edge and the counterpart blade cutting edge. In this way, the risk of injury during the use of the shearing device can be significantly reduced, and, in particular, severe injuries that can arise with the use of fly cutters can be avoided.

In order to be able to cut even relatively fine bristle filaments reliably and in the most precise possible manner during the machining of brushes, the counterpart blade cutting edge of the counterpart blade may be a notched counterpart blade cutting edge provided with cutting notches. The bristle filaments of a brush for machining by the shearing device can be reliably held within the cutting notches of the counterpart blade and severed by an interaction between the at least one helically coiled blade cutting edge, which rotates during the operation of the shearing device, and the counterpart blade cutting edge. This occurs without the bristle filaments being displaced to too great an extent by the rotating and helically coiled at least one blade cutting edge before the cut occurs.

The blade may have a cylindrical main body. The at least one helically coiled blade cutting edge may be arranged and/or formed on said cylindrical main body. In a particularly preferred embodiment of the shearing device, the blade has two or three or four or more helically coiled blade cutting edges. The shearing device thus provides a blade which has multiple helically coiled encircling blade cutting edges and which thus exhibits a relatively large cumulated cutting edge length. This can increase the service life of the blade, such that an exchange of the blade or re-grinding of the blade is required less often than in the case of blades of hitherto used shearing devices.

The shearing device may have a suction extraction device. By use of the suction extraction device, cutting waste generated during the operation of the shearing device can be directly suctioned out of the working region of the shearing device. This can promote a higher level of manufacturing quality and can furthermore reduce generation of dust and/or dirt in the working region of the shearing device.

In one embodiment, the shearing device has a suction extraction housing which at least partially houses the blade which rotates about its axis of rotation during the operation of the shearing device. By the rotational movement of the blade, the cutting waste can be moved into the interior of the suction extraction housing and suctioned from there by the suction extraction device already mentioned above. The use of the suction extraction housing can further reduce the generation of dirt during the operation of the shearing device.

In one embodiment of the shearing device, the counterpart blade is arranged and/or formed with its counterpart blade cutting edge on a suction extraction housing, for example the suction extraction housing already mentioned above. In this way, the suction extraction housing of the suction extraction device is ascribed a dual function, whereby the shearing device can ultimately be provided in a particularly compact design.

The abovementioned cutting notches of the counterpart blade may be symmetrical and/or asymmetrical cutting notches.

The counterpart blade may have cutting notches which have an acute opening angle. With such cutting notches, deflecting movements, in particular of bristle filaments for shortening by the shearing device, which possibly occur during the operation of the shearing device can be avoided. If the counterpart blade has cutting notches which have an obtuse opening angle, it is possibly easier for bristle filaments to be introduced into the cutting notches of the counterpart blade and reliably fixed there for the cutting machining process.

In one embodiment of the shearing device, cutting notches of the counterpart blade have cutting edges which are shorter than the cutting edges of respectively associated counterpart edges and/or which have a steeper gradient than counterpart edges respectively assigned to the cutting edges. In particular if the cutting edges of the cutting notches have a steeper gradient than counterpart edges assigned to the cutting edges, the cutting edges of the cutting notches can form a reliable counter-support for material for cutting, in particular for bristle filaments, which is engaged by the rotating at least one helically coiled blade cutting edge of the blade and subjected to a cutting force during the cutting process. Similarly to the case with a pair of scissors, it is thus possible for the bristle filaments to be severed in a particularly precise manner by the counterpart blade cutting edge which interacts with the at least one helically coiled blade cutting edge.

In one embodiment of the shearing device, cutting notches of the counterpart blade may have a notch depth between 0.1 mm and 10 mm. The optimum notch depth may be selected in a manner dependent on the material for cutting that is to be machined. For a particularly fine material for cutting, that is to say for example for particularly fine bristle filaments of toothbrushes, it may be advantageous to select a small notch depth. For relatively thick material for cutting, for example for bristles for the production of brooms, it may be advantageous to provide cutting notches which have a relatively large notch depth.

The at least one helically coiled blade cutting edge may have a gradient angle of between 0.1 degrees and 45 degrees. The smaller the gradient angle of the at least one helically coiled blade cutting edge, the greater the length of the blade cutting edge can be, which can ultimately lengthen the service life of the blade cutting edge. Furthermore, a smaller gradient angle of the at least one helically coiled blade cutting edge can promote a gentle cutting action.

To generate profiled cuts or profiled cut areas, in particular during the machining of bristle zones of brushes, such as for example toothbrushes, it may be advantageous if the counterpart blade cutting edge is a profiled counterpart blade cutting edge. It is for example possible for the counterpart blade cutting edge to have an undulating profile. The counterpart blade cutting edge may, as required, be of for example convex or concave or convex-concave profile. In the same way as the counterpart blade cutting edge, it is also possible for the at least one helically coiled blade cutting edge to be a profiled blade cutting edge. Here, the at least one helically coiled blade cutting edge may have an undulating profile and/or may be of convex, concave or convex-concave profile. A profiled, helically coiled blade cutting edge may be one whose imaginary envelope has a corresponding profile. It is thus possible for an envelope of a profiled, helically coiled blade cutting edge to have a convex, concave and convex-concave profile, and/or to be provided with an undulating profile.

The blade cutting edges may be of uninterrupted form. It is however basically also possible for the blade cutting edges to have notches and/or serrations and/or recesses. This can expediently influence the cutting behaviour of the shearing device in a manner dependent on the material for cutting.

The counterpart blade cutting edge may have a wedge angle of between 45 degrees and 90 degrees, in particular between 85 degrees and 90 degrees. The wedge angle of the counterpart blade cutting edge may be understood to mean the angle enclosed between the counterpart blade cutting edge and a longitudinal plane of the counterpart blade. The longitudinal plane of the counterpart blade may be oriented parallel to the axis of rotation of the blade. In the case of a counterpart blade with cutting notches, these may have a wedge angle of between 45 degrees and 90 degrees, in particular between 85 degrees and 90 degrees.

In one embodiment of the shearing device, the at least one helically coiled blade cutting edge has a wedge angle of between 10 degrees and 90 degrees.

In one embodiment of the shearing device, the at least one helically coiled blade cutting edge has a clearance angle of between 1 degree and 30 degrees. The counterpart blade may, in one embodiment of the shearing device, have an acute or an obtuse bevel angle. The bevel angle of the counterpart blade may be an angle enclosed between a bevel adjoining the counterpart blade cutting edge and a longitudinal plane of the counterpart blade. The longitudinal plane of the counterpart blade may be oriented parallel to the axis of rotation of the blade. The bevel angle of the counterpart blade may amount to between 5 degrees and 45 degrees or for example also between 45 degrees and 120 degrees.

In one embodiment of the shearing device, a wedge angle of the counterpart blade cutting edge is greater than or equal to a bevel angle of the counterpart blade which is enclosed between a bevel adjoining the counterpart blade cutting edge and a longitudinal plane of the blade. In a particularly advantageous embodiment of the shearing device, the at least one helically coiled blade cutting edge is arranged on a web which runs in helically coiled fashion around the axis of rotation of the blade. This web may have a web width of 0.3 mm to 5 mm and/or a web height of 1 mm to 20 mm. Free spaces that may form between adjacent portions of the helically coiled encircling web on the blade may be used for receiving and discharging cutting waste. In this way, the cutting waste generated during the use of the shearing device can be received by the blade rotating about its axis of rotation and for example transported in the direction of the suction extraction device as already mentioned above.

All embodiments of the shearing device according to the invention are distinguished by relatively little generation of dirt. Whereas, in the case of fly cutters such as are already known from practice, during the machining of bristle filaments, the cutting waste can be shot away at relatively high speeds owing to the momentum of the cutting blade and under some circumstances adversely affects the production in other areas, this is prevented in the case of the shearing device according to the invention owing to the different cutting principle. The speed with which the at least one helically coiled blade cutting edge is moved past the counterpart blade cutting edge in the direction of the axis of rotation can be considerably lower. Thus, the cut-off part of a bristle filament, for example, has considerably less momentum imparted to it by the impacting of the blade cutting edge of the shearing device, such that said part is not shot out, or is not shot out far, from the cutting region of the shearing device. In interaction with the suction extraction device already mentioned above, it is possible in an effective manner to prevent the cutting waste that is generated during the use of the shearing device from passing out of the cutting region of the blade.

The blade may have, between the at least one helically coiled blade cutting edge and a flank of the blade cutting edge, a transition surface which is parallel to the axis of rotation of the blade. The flank may have a width, measurable in the direction of the axis of rotation, of between 0.001 mm and 0.3 mm. This can simplify regrinding of the blade.

In one embodiment of the shearing device, cutting notches of the counterpart blade have a profile direction which is oriented at right angles or obliquely with respect to a main extent direction of the counterpart blade cutting edge. The profile direction of the cutting notches of the counterpart blade may for example be oriented at an angle of between 10 degrees and 80 degrees with respect to the main extent direction of the counterpart blade cutting edge.

The shearing device may have a holder for a workpiece, in particular a holder for a brush, preferably for a round brush and/or for a toothbrush.

In one embodiment of the shearing device, said shearing device has a multi-axis robot for the handling of a workpiece and/or for the feed and/or manipulation of the workpiece at the blade. With a correspondingly programmed multi-axis robot, it is possible to perform freeform machining of a workpiece at the shearing device. It is thus possible to generate brushes with particularly complex bristle zone geometries.

In one embodiment of the shearing device, said shearing device has a multi-axis robot on which the blade and/or the counterpart blade are arranged. In this way, the blade and/or the counterpart blade can be moved relative to a, preferably fixed, workpiece in order to perform the abovementioned freeform machining of the workpiece.

For the machining of bristled brushes, the shearing device may have a bristle displacement device. By use of such a bristle displacement device, individual bristles, individual bristle bundles or even groups of bristle bundles can be displaced such that they are not engaged by the blade and counterpart blade of the shearing device. In this way, it is possible for even complex bristle zone geometries to be generated by the shearing device. Here, different groups of bristle filaments or bristle bundles can be shortened to different lengths. For this purpose, the bristle filaments are machined gradually. Bristle filaments which are initially not to be shortened, or which are initially to be shortened to a different length, can be displaced out of the region of action of the shearing device by the bristle displacement device.

To achieve the object, there is finally also provided a brush production machine which has one or more features of the invention directed to such a brush production machine. To achieve the object, it is thus provided, in the case of a brush production machine of the type mentioned in the introduction, for said brush production machine to be equipped with a shearing device with one or more features of the invention.

Finally, to achieve the object, there is also proposed the use of a shearing device according to any of the claims directed to a shearing device for cutting bristle filaments to length.

BRIEF DESCRIPTION OF THE DRAWINGS

The invention will be described in more detail below on the basis of multiple exemplary embodiments. The invention is however not restricted to these exemplary embodiments. Further exemplary embodiments will emerge from combination of the features of individual or several patent claims with one another and/or in the combination of individual or several features of the exemplary embodiments. In the figures, in part in a highly schematic illustration:

FIG. 1 shows a side view of a first embodiment of a shearing device according to the invention for machining bristles that have been rotated in.

DETAILED DESCRIPTION

Figure 1:
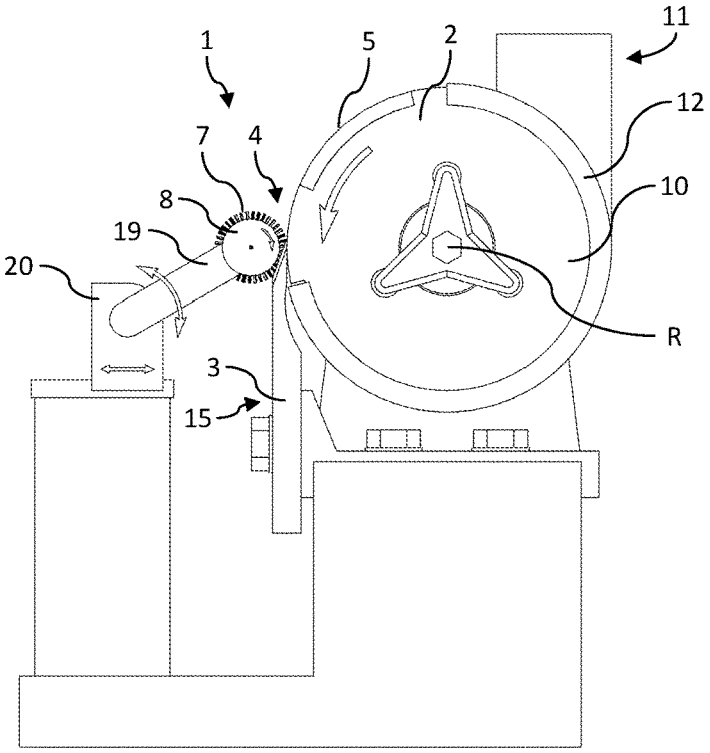
Figure 2:
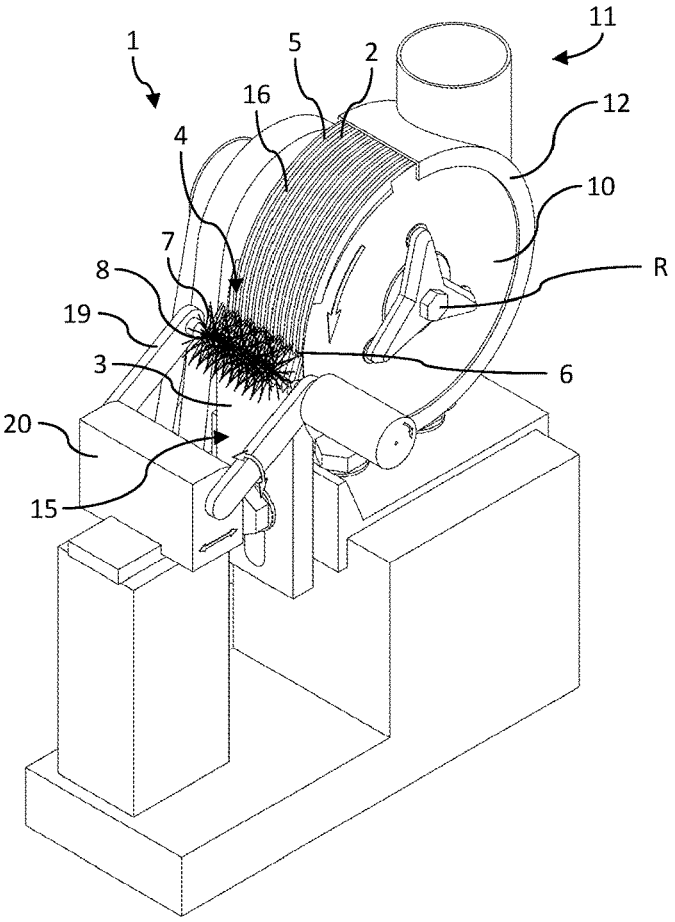
FIG. 2 shows a perspective view of the shearing device shown in FIG. 1.

In the following description of various embodiments of the invention, elements which correspond in terms of their function are denoted by corresponding reference designations even in the case of different design or shaping.

All of the figures show constituent parts of different embodiments of shearing devices which are denoted as a whole by 1. Unless separately stated, the following description relates to all embodiments of the shearing devices 1.

The shearing device 1 has a blade 2 and a counterpart blade 3 assigned to the blade 2. The blade 2 is rotatable about an axis of rotation R in order to generate a cutting movement relative to a counterpart blade cutting edge 4 of the counterpart blade 3. The blade 2 of the shearing devices 1 illustrated in the figures has a total of four blade cutting edges 5, which are helically coiled about the axis of rotation R of said blade. It can be clearly seen that each helically coiled blade cutting edge 5 runs all the way around the axis of rotation R of the blade 2 multiple times.

Figure 3:
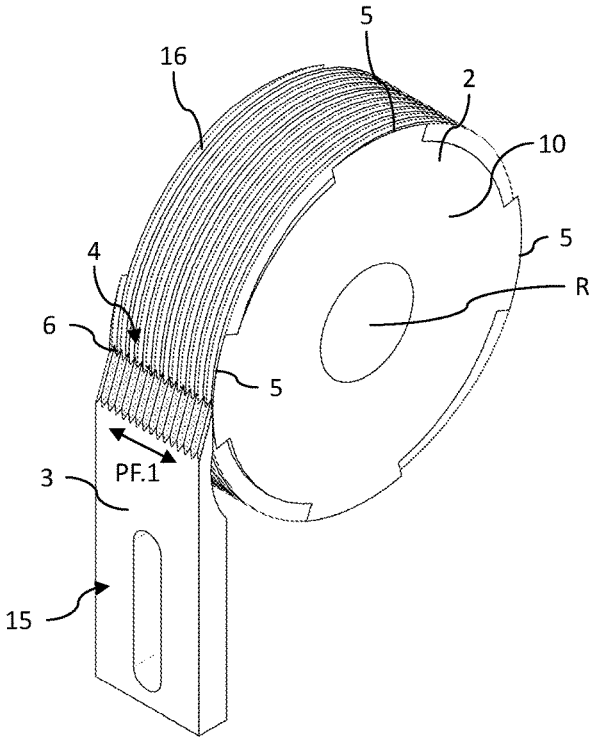
FIG. 3 shows a perspective view of a blade with a total of four blade cutting edges running in helically coiled encircling fashion about its axis of rotation and of a counterpart blade which is assigned to the blade and which has a notched counterpart blade cutting edge.
Figure 7:
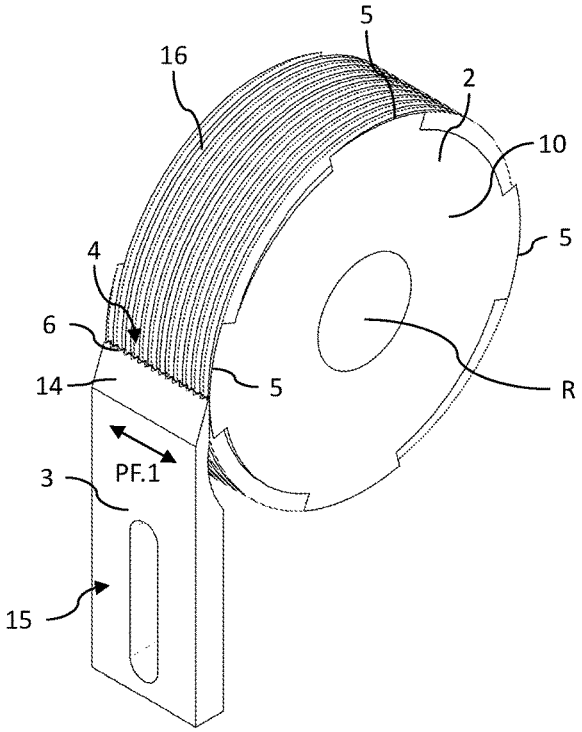
Figure 11:
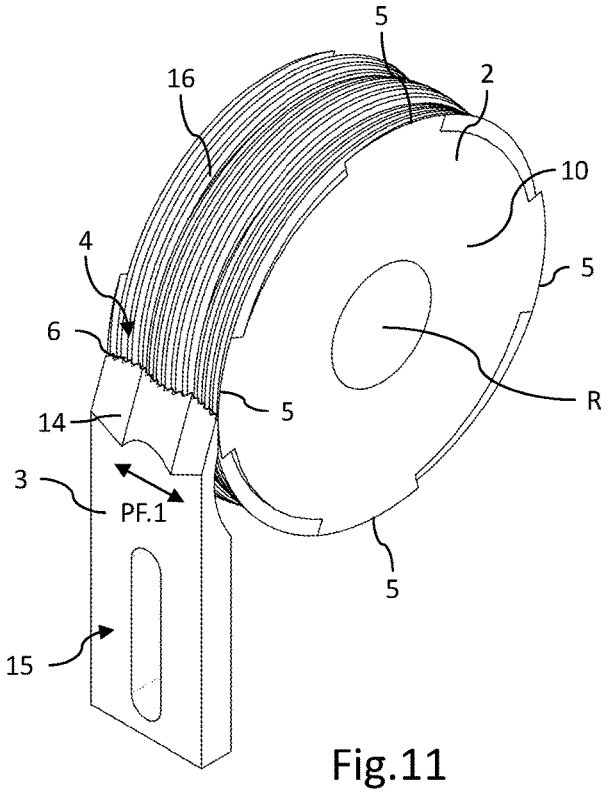
FIG. 11 shows a perspective view of a profiled blade with a profiled counterpart blade assigned thereto.

It is clear from FIGS. 3, 7 and 11 that the blade 2 and the counterpart blade 3 have a very small spacing to one another, if any, in the use position. The cutting principle on which the shearing device 1 operates eliminates the need to vary the spacing of the blade 2 with respect to the counterpart blade 3 for the cutting process. A spacing previously set between the blade 2 and the counterpart blade 3 is kept constant during the operation of the shearing device 1. The spacing may, depending on the material for cutting, lie between 0 mm and 0.5 mm, particularly preferably between 0 mm and 0.1 mm. A spacing between 0 mm and 0.1 mm is particularly highly suitable for machining bristle filaments of brushes, for example, using the shearing device 1.

Figure 4:
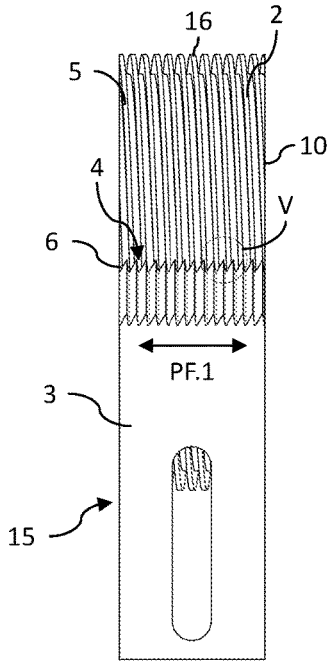
FIG. 4 shows a side view of the blade shown in FIG. 3 with the counterpart blade thereof.
Figure 6:
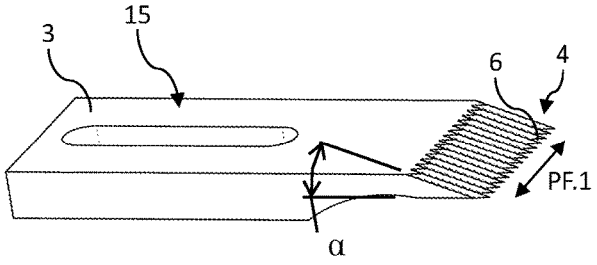
FIG. 6 shows a perspective view of the counterpart blade illustrated in FIGS. 3 and 4, FIGS. 7-10 show different views of a further embodiment of a counterpart blade.
Figure 8:
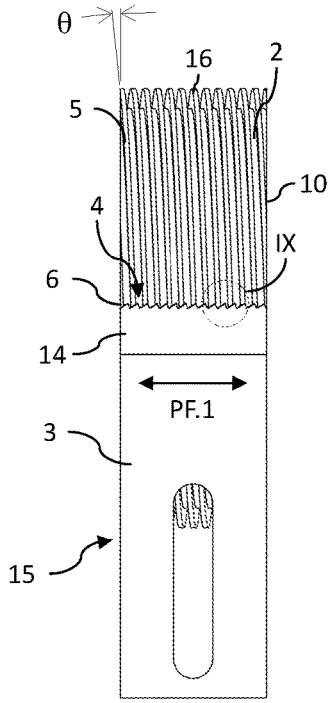
Figure 9:
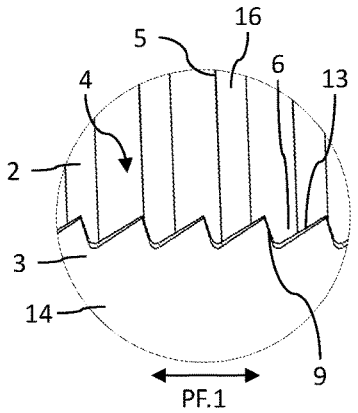
Figure 10:
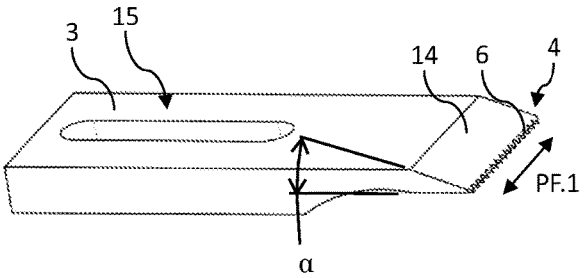
Figure 12:
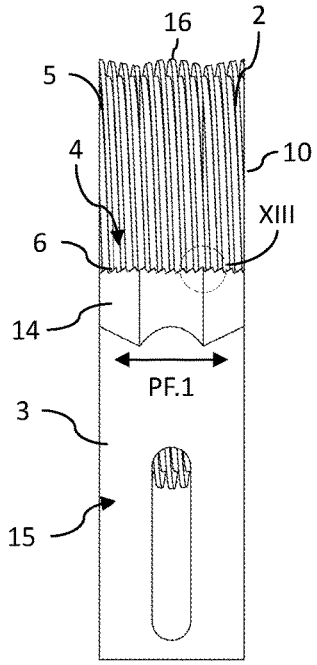
FIGS. 12-14 show different views of the profiled blade illustrated in FIG. 11 and of the profiled counterpart blade illustrated in FIG. 1, FIGS. 15-34 show different variants of blades and counterpart blades, in part in an enlarged illustration.
Figure 14:
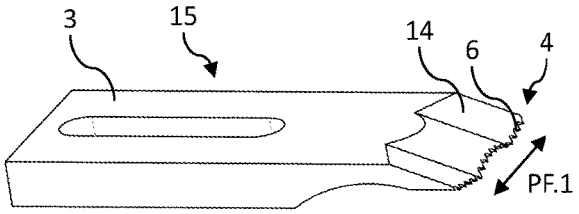
Figure 15:
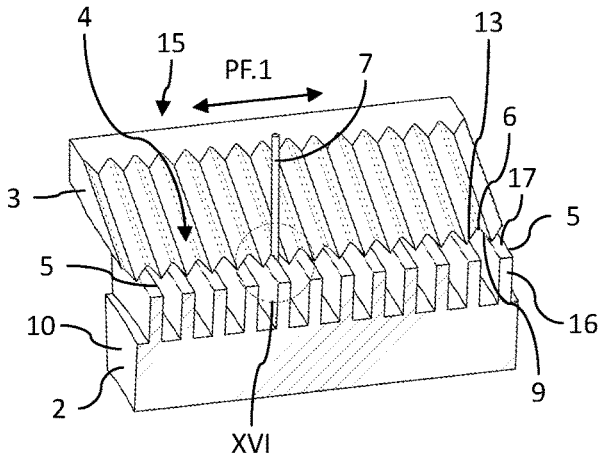
Figure 16:
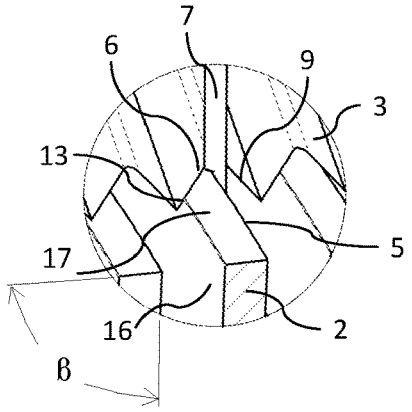
Figure 17:
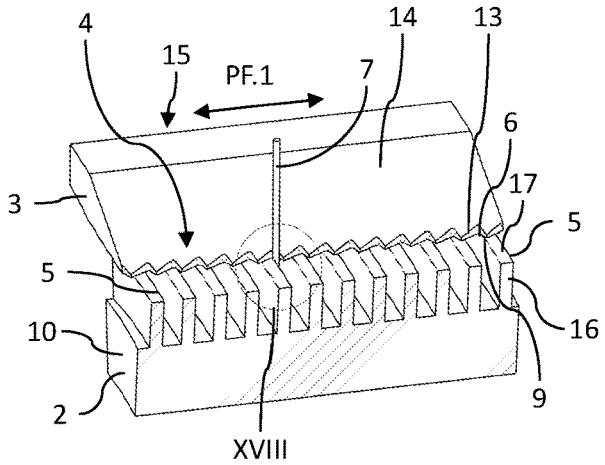
Figure 18:
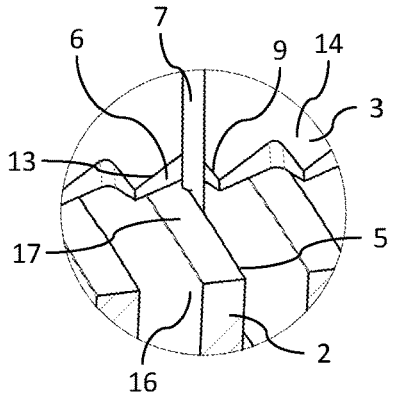
Figure 19:
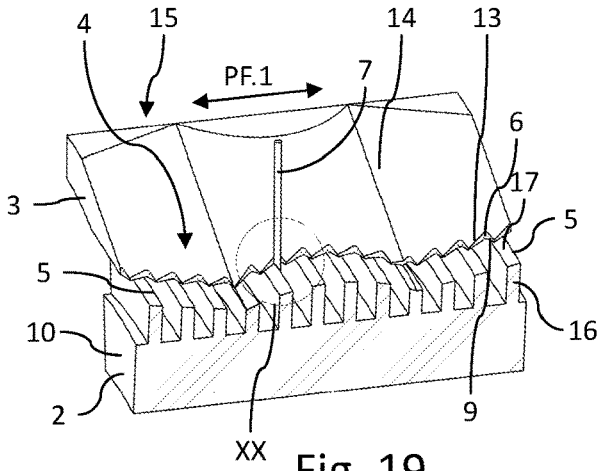
Figure 20:
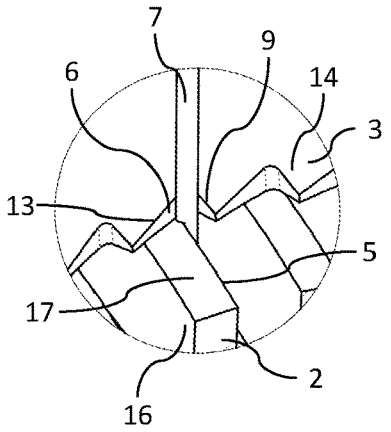
Figure 21:
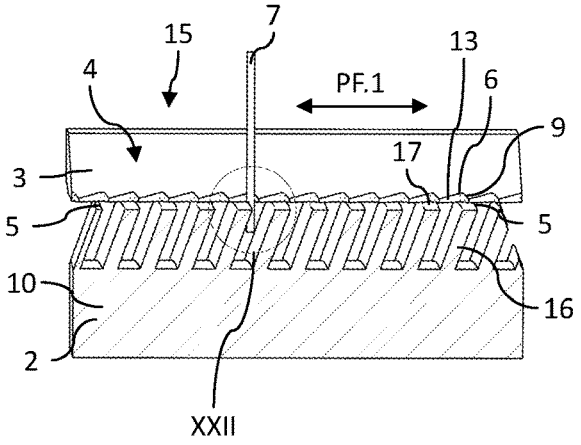
Figure 22:
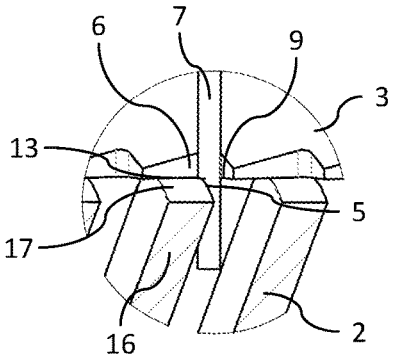
Figure 23:
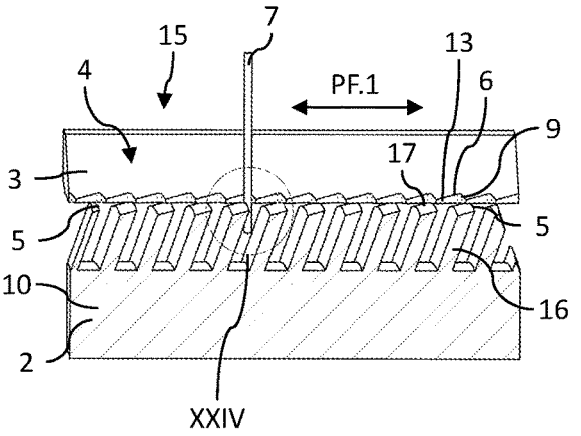
Figure 24:
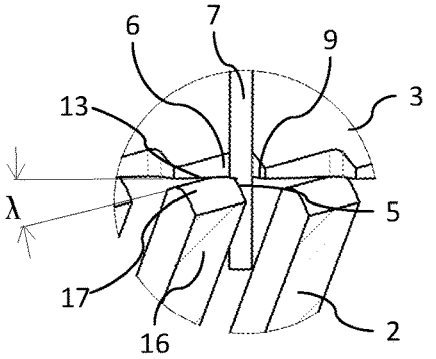

FIGS. 6, 10 and 14 illustrate that the counterpart blade cutting edge 4 has a main extent direction which is oriented transversely with respect to a longitudinal axis of the counterpart blade 3. FIGS. 4, 8 and 12 show that the counterpart blade cutting edge 4 has a main extent direction PF.1, which is also perpendicular to the main extent direction of the four helically coiled blade cutting edges 5 of the blade 2. It can furthermore be seen that the main extent direction PF.1 of the counterpart blade cutting edge 4 of the respective counterpart blade 3 is also oriented in the direction of the axis of rotation R or even parallel to the axis of rotation R of the blade 2.

All of the counterpart blades 3 illustrated in the figures are counterpart blade 3 whose counterpart blade cutting edge 4 is a notched counterpart blade cutting edge provided with cutting notches 6.

Due to the cutting notches 6 of the counterpart blade cutting edge 4, it is possible for bristle filaments 7 of brushes 8 for machining to be held on the counterpart blade 3. By the blade cutting edges 5 rotating about the axis of rotation R, it is then possible for the bristle filaments 7 of the brushes 8 for machining, which bristle filaments are situated in the cutting notches 6, to be reliably severed without the bristle filaments 7 being able to deflect to too great an extent when the rotating blade cutting edges 5, during the cutting movement caused by the rotation about the axis of rotation R of the blade 2, move toward cutting edges 9 of the cutting notches 6.

FIGS. 3, 7 and 11 furthermore show that the blade 2 has a cylindrical main body 10. Four helically coiled blade cutting edges 5 are formed on said cylindrical main body 10.

The shearing devices shown in FIGS. 1, 2, 35 and 40 and 41 are each equipped with a suction extraction device 11. Here, the suction extraction device 11 is assigned in each case to the blade 2 of the shearing device 1. The suction extraction devices 11 are equipped with suction extraction housings 12 which at least partially house the blades 2. The suction extraction housings 12 surround the blades 2 mounted rotatably therein over an angle range of between 180 and 270 degrees. By the rotation of the respective blade 2 about its axis of rotation R, severed bristle filament pieces are conveyed into the interior of the respective suction extraction housing 12 and are finally extracted by suction by the suction extraction device 11. In this way, contamination of the working region of the shearing device 1 with cutting waste can be reliably prevented.

Figure 40:
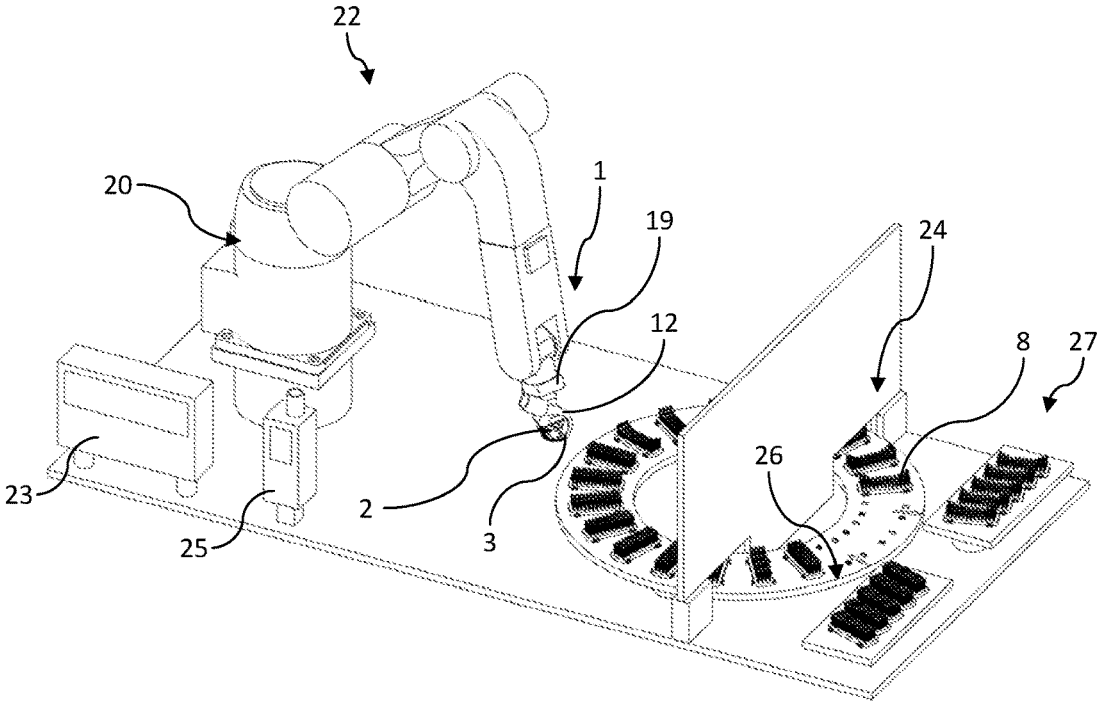
FIG. 40 shows a perspective illustration of a brush production machine equipped with a shearing device.
Figure 41:
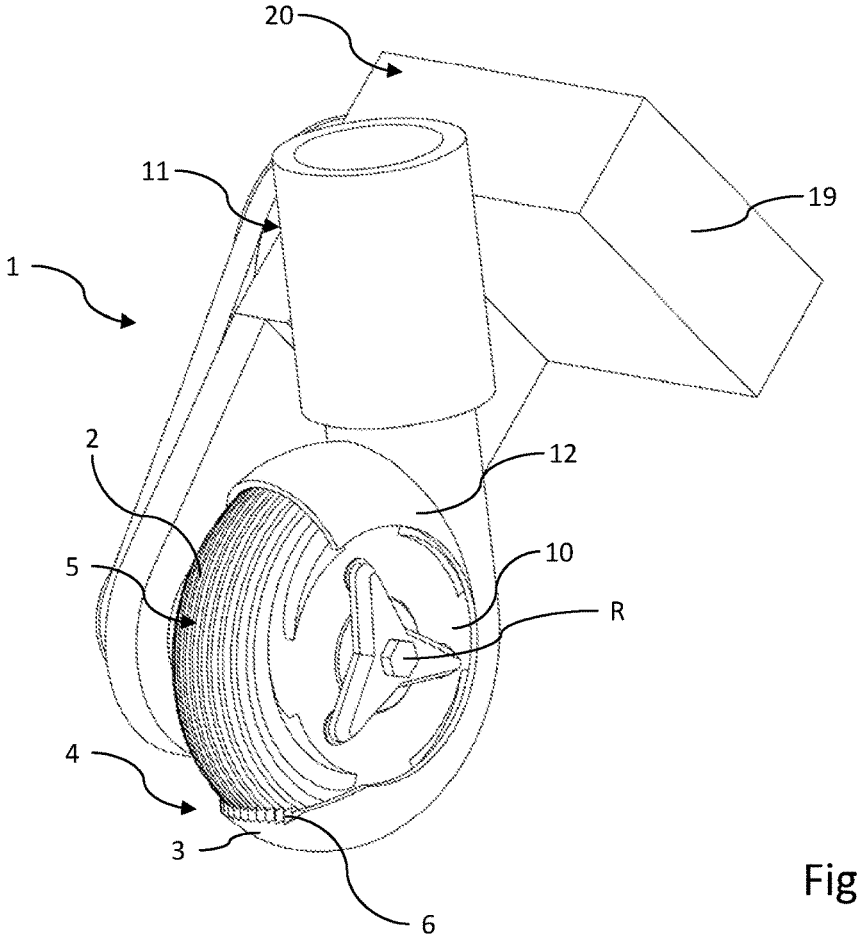
FIG. 41 shows an individual-part illustration of the shearing device suspended, in FIG. 40, on the end of a robot arm.

In the exemplary embodiment of a shearing device 1 illustrated in FIGS. 40 and 41, the counterpart blade 3 is arranged or formed on the suction extraction housing 12. In this way, the shearing device is provided with a particularly compact design with a small space requirement. In embodiments of the shearing device not shown in the figures, the counterpart blade 3 is provided with symmetrical cutting notches. All of the counterpart blades 3 shown in the figures have asymmetrical cutting notches 6. The reason for this is that the cutting edges 9 of the cutting notches 6 have a steeper gradient, or are steeper, than the counterpart edges 13 respectively assigned to the cutting edges 9.

The enlarged detail views of the counterpart blades 3 (see FIGS. 5, 9, 13, 16, 18, 20, 22, 24, 26, 28, 30, 32 and 34) show cutting notches 6 of different design. Some of these cutting notches 6 have an acute opening angle, whereas other cutting notches 6 have more obtuse opening angles in relation thereto. In the case of all counterpart blades 3, provision is made whereby the cutting notches 6 have cutting edges 9 which are shorter than counterpart edges 13 assigned to the cutting edges 9. Furthermore, as already mentioned above, the cutting edges 9 also have a steeper gradient than the counterpart edges 13 assigned thereto.

Figure 5:
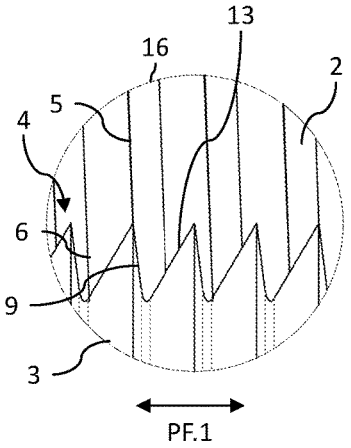
FIG. 5 shows the detail marked in FIG. 4 with the circle V in an enlarged illustration.

In the exemplary embodiment of the counterpart blade 3 illustrated on an enlarged scale in FIG. 5, the cutting edges 9 of the cutting notches 6 are oriented at an angle of somewhat less than 90 degrees with respect to a main extent direction PF.1 of the counterpart blade cutting edge 4. It is preferable for the angle enclosed between the respective cutting edge 9 and the main extent direction of the counterpart blade cutting edge 4 to lie between 45 degrees and 90 degrees.

The counterpart edges 13 assigned to the cutting edges 9 enclose an angle of between 30 degrees and 80 degrees with the main extent direction PF.1 of the counterpart blade cutting edge 4, which in the use position of the counterpart blade 3 is oriented parallel to an axis of rotation R of the blade 2, and said counterpart edges are accordingly provided with a shallower gradient than the cutting edges 9.

The cutting notches 6 of the counterpart blades 3 illustrated in the figures have a notch depth of between 0.1 mm and 10 mm. The notch depths may be selected in a manner dependent on the material that is to be cut by the shearing device 1.

The helically coiled blade cutting edges 5 of the blades 2 shown in the figures have a gradient angle θ, indicated in FIG. 8, which may amount to between 0.1 degrees and 45 degrees depending on the usage situation.

FIGS. 11 to 14 and 36 to 41 show counterpart blades 3, the counterpart blade cutting edges 4 of which are profiled counterpart blade cutting edges. The counterpart blade cutting edges 4 shown in FIGS. 11 to 14 are counterpart blade cutting edges 4 with a convex-concave profiling or curvature, which therefore have an undulating profile. The counterpart blade cutting edges 4 shown in FIGS. 38 to 41 have a semi-circular profile, that is to say are counterpart blade cutting edges 4 with a concave profiling.

Figure 13:
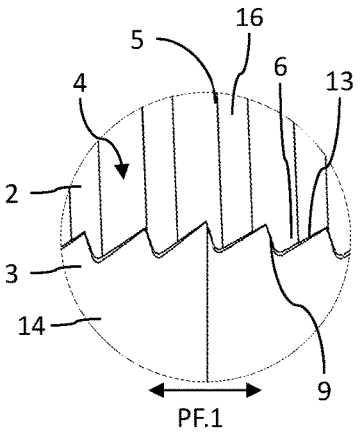

The blade cutting edges 5 of the blades 2 are profiled correspondingly to the profile of the counterpart blade cutting edges 4 assigned thereto. Accordingly, the blade 2 illustrated in FIGS. 11 to 13 is equipped with blade cutting edges 5 with a convex-concave profiling. The blade 2 illustrated in FIGS. 38 to 41 has blade cutting edges 5 running in helically coiled fashion along a convex line. The blades 2 with profiled blade cutting edges 5 have imaginary envelopes which are themselves correspondingly profiled. A profiled blade cutting edge 5 may, in the context of the described shearing devices 1, be understood to mean a blade cutting edge 5 around which an imaginary envelope can be placed which itself has a corresponding concave, convex and/or convex-concave and/or undulating profiling.

The blade cutting edges 5 shown in the figures are of uninterrupted form. It is however basically possible for the blade cutting edges 5 to be equipped with notches or serrations or recesses. This can expediently influence the cutting behaviour of the shearing device 1 in a manner dependent on the material for cutting.

Figure 29:
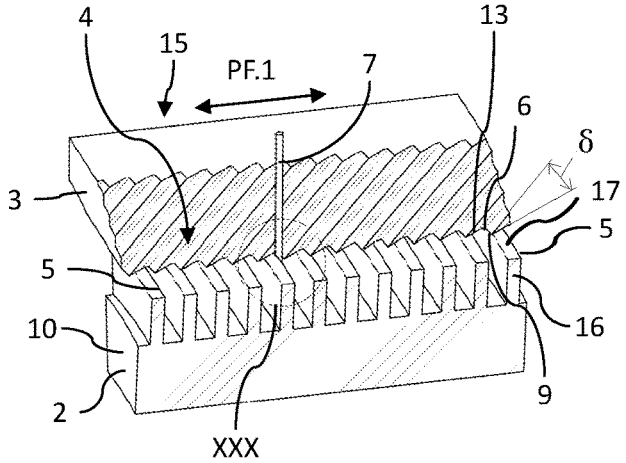
Figure 30:
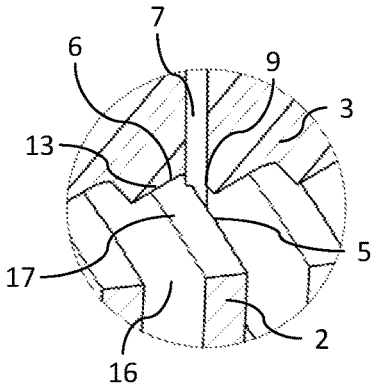
Figure 31:
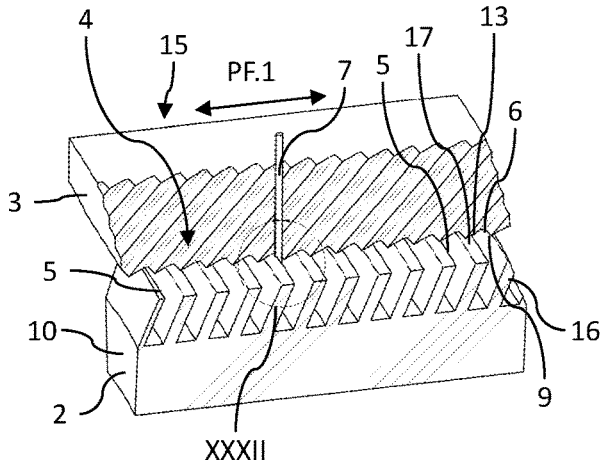
Figure 32:
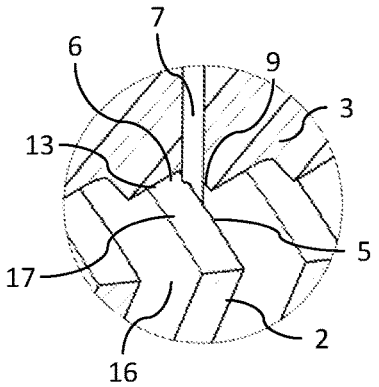
Figure 33:
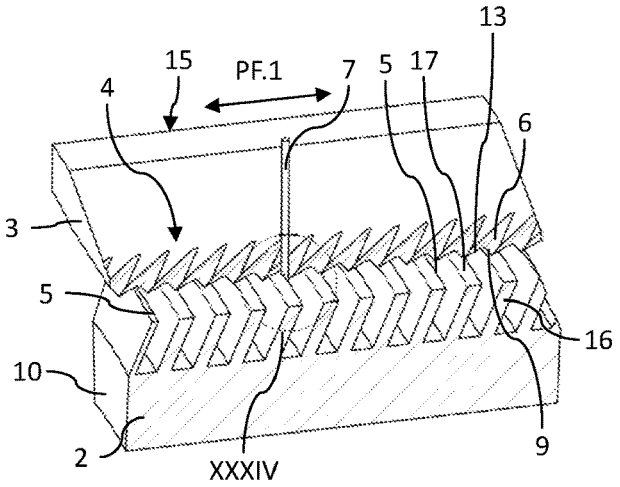
Figure 34:
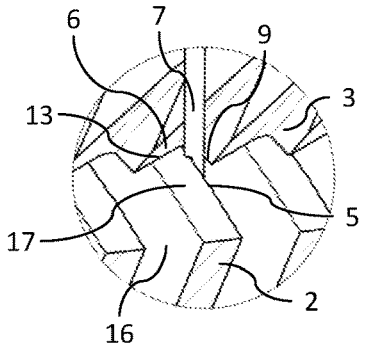

The counterpart blade cutting edge 4 and in particular the cutting notches 6 of the counterpart blade cutting edge 4 of the counterpart blade 3 shown in the figures have a wedge angle δ of between 45 degrees and 90 degrees, in particular between 85 degrees and 90 degrees. Here, a wedge angle δ may be understood to mean the angle enclosed between the counterpart blade cutting edge 4 and an imaginary longitudinal plane of the counterpart blade 3 (indicated for example in FIG. 29).

The helically coiled blade cutting edges 5 have wedge angles β (indicated in FIG. 16) between 10 degrees and 90 degrees.

The helically coiled blade cutting edges 5 furthermore have clearance angles λ (indicated in FIG. 24 between a longitudinal plane of the counterpart blade 3 and the trailing blade flank 17 behind the cutting edges 5 of the helically coiled blade) of between 1 degree and 30 degrees. The counterpart blades 3 may have an acute or an obtuse bevel angle α (indicated in FIGS. 6 and 10), wherein the bevel angle α is the angle enclosed between a bevel 14 adjoining the counterpart blade cutting edge 4 and an imaginary longitudinal plane of the counterpart blade 3. The bevel angle α of the counterpart blades 3 may amount to between 5 degrees and 45 degrees or else between 45 degrees and 120 degrees.

In the case of the counterpart blades 3 shown in FIGS. 14, 18, 20, 22, 24 and 26, a wedge angle of the counterpart blade cutting edge 4, in particular wedge angle δ of the cutting notches 6 of the counterpart blade cutting edge 4, is greater than a bevel angle α of the respective counterpart blade 3, which is enclosed between the bevels 14 adjoining the counterpart blade cutting edge 4 and the longitudinal plane, already mentioned above, of the counterpart blade 3. It is pointed out at this juncture that the longitudinal plane of the counterpart blade 3 shown in the figures is parallel to a planar front side 15 of the counterpart blade 3.

The helically coiled blade cutting edges 5 of the blades 2, shown in the figures, of the shearing devices 1 are each arranged on a web 16 which runs in helically coiled encircling fashion around the respective axis of rotation R of the blade 2. The webs 16 have a web width of between 0.3 mm and 5 mm and a web height of 1 mm to 20 mm, and may be produced for example by milling machining of the main body 10.

Figure 25:
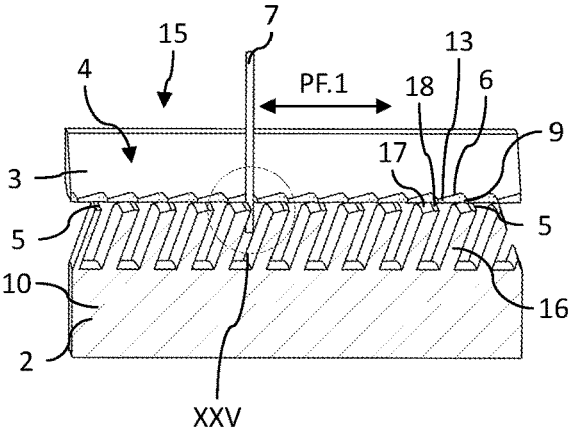
Figure 26:
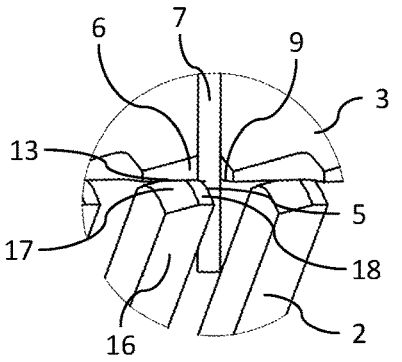
Figure 27:
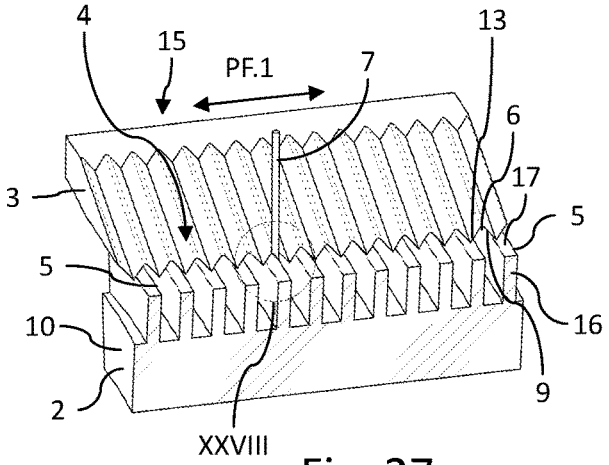
Figure 28:
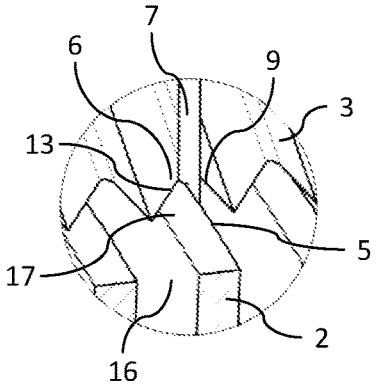

The blade 2 shown in FIGS. 25 and 26 has, between its helically coiled blade cutting edges 5 and a respective flank 17 of the respective blade cutting edge 5, a transition surface 18 which is parallel to the axis of rotation R of the blade 2. This transition surface 18 has a width, measurable in the direction of the axis of rotation R of the blade 2, of between 0.001 mm and 0.3 mm and serves for simplifying the regrinding of the blade 2 and of its helically coiled blade cutting edges 5.

In FIGS. 3 to 16 and 27, 28 and 38 to 41, the cutting notches 6 of the respectively illustrated counterpart blades 3 have a profile direction which is oriented at right angles to the main extent direction PF.1 of the counterpart blade cutting edge 4 and furthermore at right angles to the axis of rotation R of the respective blade 2 of the shearing device 1 that is shown.

The rest of the counterpart blades 3 have cutting notches 6, the profile direction of which is oriented obliquely with respect to a main extent direction of the counterpart blade cutting edge 4, and also obliquely with respect to the axis of rotation R of the blade 2, when the counterpart blade 3 is situated in its use position on the shearing device 1. The orientation of the profile directions of the cutting notches 6 may in this case amount to between 10 degrees and 80 degrees. These obliquely oriented cutting notches 6 result in relatively small wedge angles at the cutting edges 9 of the cutting notches 6, which can ultimately promote a finer cutting pattern.

Each shearing device 1 shown in the figures furthermore has a holder 19 for a workpiece, in this case a brush 8. In the case of the shearing device 1 shown in FIGS. 1 and 2, said holder 19 is a pivotably mounted holder 19 which is adapted to a round brush and which is furthermore configured to set the round brush 7 clamped thereon in rotation for the purposes of machining at the shearing device 1.

Figure 35:
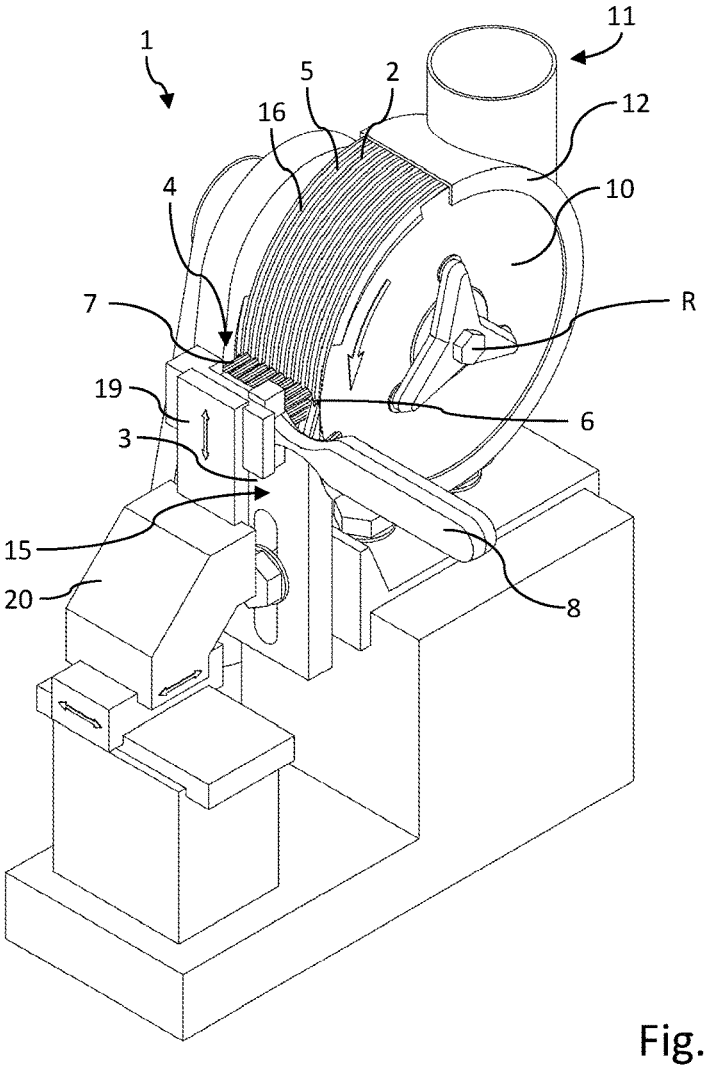
FIG. 35 shows a further perspective view of an embodiment of a shearing device, wherein said shearing device is equipped with a brush holder for a brush for machining.
Figure 36:
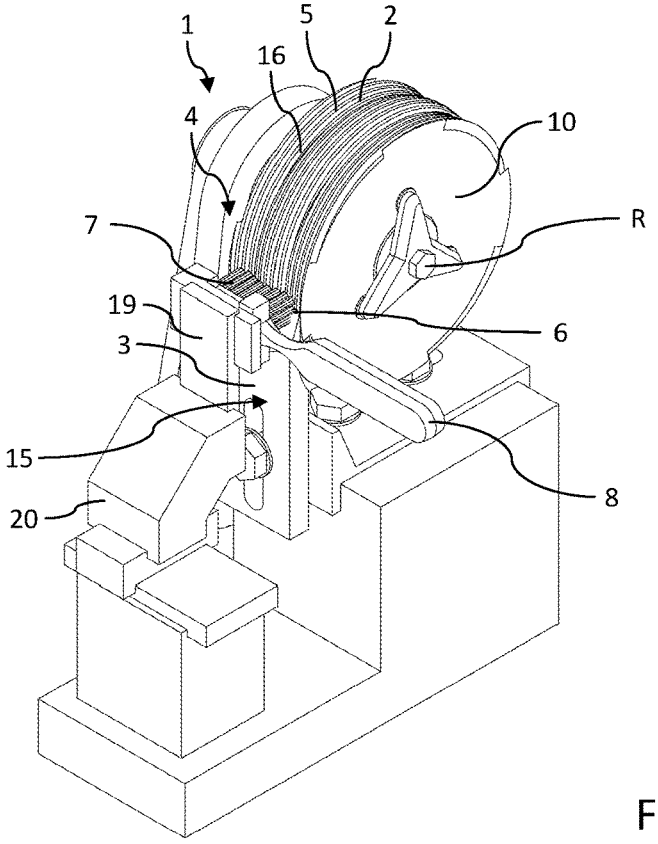
FIG. 36 shows the shearing device shown in FIG. 35 with profiled blade and profiled counterpart blade.
Figure 37:
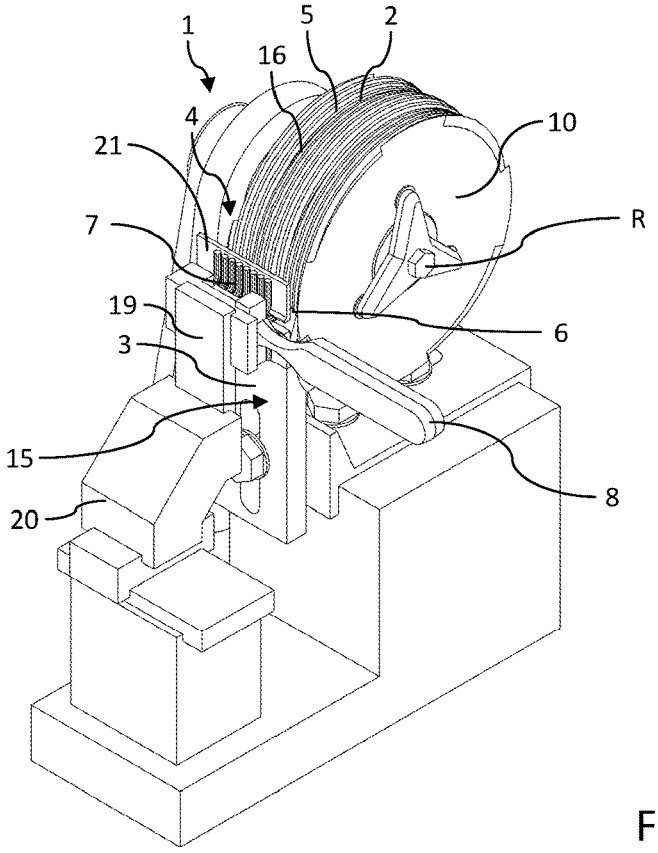
FIG. 37 shows the shearing device shown in FIG. 36 with a displacement device for bristle filaments in engagement with a brush clamped on the holder.

The shearing device 1 shown in FIGS. 35 to 37 has a holder 19 which is configured for holding a toothbrush. Furthermore, it is possible here for the holder 19 to be moved in three different axes relative to the blade 2 and the counterpart blade 3, in order to feed the bristle filaments 7 of the brush clamped on the holder 19 to the blade 2 and the counterpart blade 3.

Figure 38:
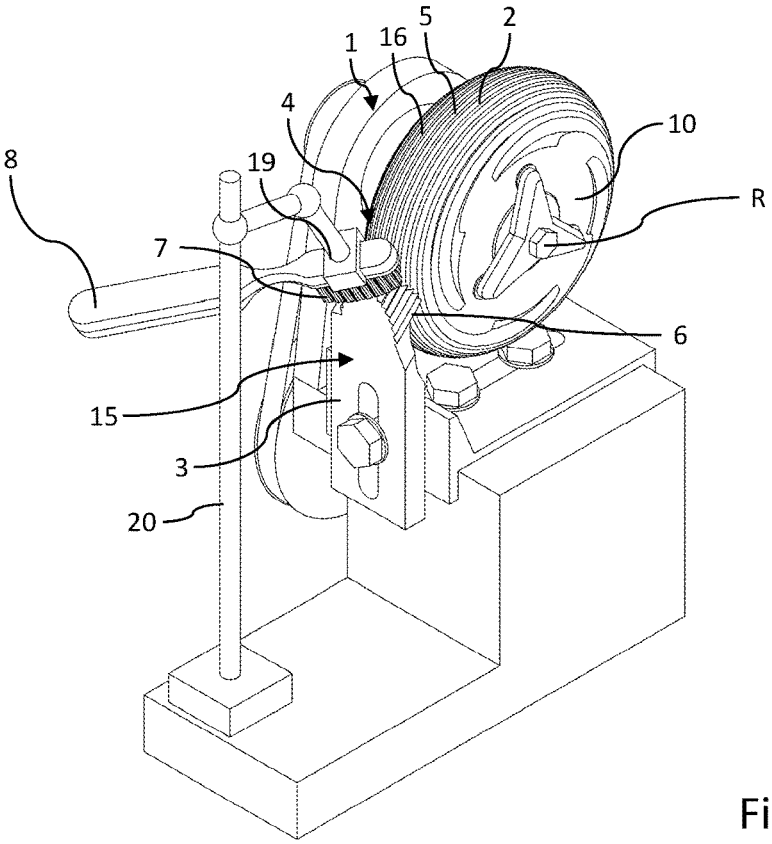
FIG. 38 shows a further embodiment of a shearing device with a convexly profiled blade, a convexly profiled counterpart blade and with a multi-axis robot as a handling device for handling workpieces, in this case brushes.
Figure 39:
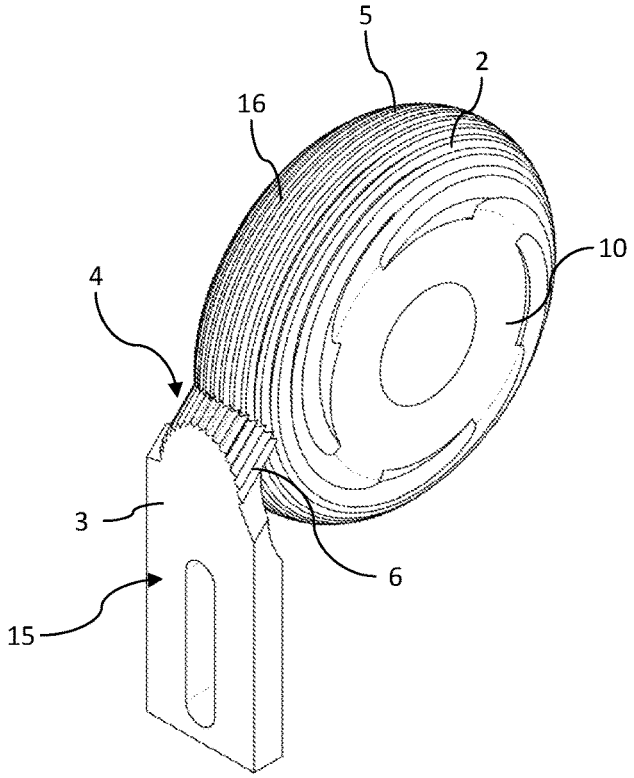
FIG. 39 shows a perspective detail illustration of the blade and of the counterpart blade of the shearing device shown in FIG. 38.

The shearing device 1 shown in FIG. 38 has a multi-axis robot 20 for handling the brush, more generally the workpiece 8. By this multi-axis robot 20, on which a holder 19 for the brush 8 is arranged, the brush 8 can be fed to the blade 2 and the counterpart blade 3 of the shearing device 1 for the purposes of machining, and the brush 8 can also be handled.

The shearing device 1 as per FIG. 40 has a multi-axis robot 20 on which both the blade 2 and the counterpart blade 3 of the shearing device 1 are arranged. The shearing device 1 shown in FIG. 37 has a bristle displacement device 21. By the bristle displacement device 21, bristle filaments 7 of a brush clamped on the holder 19 of the shearing device 1 can be laterally displaced in order to be able to machine individual bristle filaments 7 or groups of bristle filaments 7 separately from the other bristle filaments 7 of the brush 8.

FIG. 40 finally shows a brush production machine denoted as a whole by 22, which brush production machine is equipped with a shearing device 1. The brush production machine 22 has a control unit 23, by which functional units of the brush production machine 22, such as for example a rotary indexing table 24 and self-evidently also the shearing device 1 and in particular the multi-axis robot 20, can be controlled. Adjacent to the control unit 23, it is possible to see a negative-pressure source 25 of the suction extraction device 11 as already mentioned and described in detail above. Not illustrated here is a connecting hose via which the suction extraction housing 12 of the suction extraction device 11, which is arranged on the multi-axis robot 20, is connected to the negative-pressure source 25 of the suction extraction device 11.

The rotary indexing table 24 is assigned an infeed station 26 and a removal station 27 of the brush production machine 22. By the removal station 27, machined brushes 8 can be removed from the rotary indexing table 24 of the brush production machine 22. By the infeed station 26, brushes 8 that have not yet been machined are fed to the rotary indexing table 24 and via the latter to the shearing device 1 for the machining of the bristle filaments 7 of the brushes 8.

The shearing device 1 shown in the figures is thus suitable for cutting bristle filaments 7 to length during the machining and production of brushes 8.

The invention is concerned with improvements in the technical field of shearing devices. For this purpose, inter alia, the shearing device 1 is provided, which has a blade 2 with at least one blade cutting edge 5 which is helically coiled, and rotatable, about an axis of rotation R of the blade 2. The blade cutting edge 5 is assigned a counterpart blade cutting edge 4 of a counterpart blade 3. The shearing movements, by which for example bristle filaments 7 of brushes 8 for machining can be cut to length, are generated by the relative rotational movement of the at least one helically coiled blade cutting edge 5 with respect to the preferably static counterpart blade cutting edge 4 of the counterpart blade 3. Since the blade 2 and the counterpart blade 3 can keep their spacing to one another constant during the operation of the shearing device 1, the shearing device 1 is distinguished by a relatively low risk of injury during the use thereof.

LIST OF REFERENCE DESIGNATIONS

1 Shearing device
2 Blade
3 Counterpart blade
4 Counterpart blade cutting edge
5 Blade cutting edge
6 Cutting notch
7 Bristle filament
8 Brush
9 Cutting edge in 6
10 Main body of 2
11 Suction extraction device
12 Suction extraction housing
13 Counterpart edge in 6
14 Bevel on 3
15 Front side of 3
16 Web on 2
17 Flank on 2
18 Transition surface on 2
19 Holder
20 Multi-axis robot
21 Bristle displacement device
22 Brush production machine
23 Control unit
24 Rotary indexing table
25 Negative-pressure source of 11
26 Infeed station
27 Removal station

The invention claimed is:

1. A shearing device (1), comprising:
a blade (2) having at least one blade cutting edge (5);
a counterpart blade (3) assigned to the blade (2);
the blade (2) is rotatable about an axis of rotation (R) in order to generate a cutting movement relative to a fixed counterpart blade cutting edge (4) of the counterpart blade (3);
the at least one blade cutting edge (5) is helically coiled about the axis of rotation (R);
the fixed counterpart blade cutting edge (4) includes cutting notches (6) to form a notched counterpart blade cutting edge; and
the cutting notches in the counterpart blade (3) are asymmetrical cutting notches (6).

2. The shearing device (1) according to claim 1, wherein at least one of: (a) the at least one helically coiled blade cutting edge (5) extends all the way around the axis of rotation (R) of the blade (2) at least once, (b) the blade (2) and the counterpart blade (3) have a spacing of between 0 mm and 0.5 mm to one another, or (c) a spacing between the blade (2) and the counterpart blade (3) is constant during operation of the shearing device (1).

3. The shearing device (1) according to claim 1, wherein the counterpart blade cutting edge (4) has a main extent direction which is at least one of oriented transversely with respect to a main extent direction of the at least one helically coiled blade cutting edge (5), oriented in a same direction as the axis of rotation (R), or in a direction parallel to the axis of rotation (R) of the blade (2).

4. The shearing device (1) according to claim 1, wherein the blade (2) has a cylindrical main body (10), on which the at least one helically coiled blade cutting edge (5) is at least one of arranged or formed, or the at least one blade cutting edge (5) comprises two or more helically coiled blade cutting edges (5).

5. The shearing device (1) according to claim 1, further comprising a suction extraction device (11) assigned to the blade (2).

6. The shearing device (1) according to claim 5, further comprising a suction extraction housing (12) which at least partially houses the blade (2).

7. The shearing device (1) according to claim 6, wherein the counterpart blade (3) is at least one of arranged or formed on the suction extraction housing (12).

8. The shearing device (1) according to claim 1, wherein cutting notches (6) of the counterpart blade (3) have cutting edges (9) which are at least one of shorter than counterpart edges (13) assigned to the cutting edges (9) or have a steeper gradient than the counterpart edges (13) assigned to the cutting edges (9).

9. The shearing device (1) according to claim 1, wherein cutting notches (6) of the counterpart blade (3) have a notch depth between 0.1 mm and 10 mm.

10. The shearing device (1) according to claim 1, wherein the at least one helically coiled blade cutting edge (5) has a gradient angle (θ) between 0.1° and 45°.

11. The shearing device (1) according to claim 1, wherein the counterpart blade cutting edge (4) is a profiled counterpart blade cutting edge having at least one of an undulating profile, a convex profile, a concave profile, or a convex-concave profile, and the at least one helically coiled blade cutting edge (5) is a profiled blade cutting edge having at least one of an undulating profile, a convex profile, a concave profile, or a convex-concave profile, or an envelope of the blade (4) has at least one of an undulating profile, a convex profile, a concave profile, or a convex-concave profile.

12. The shearing device (1) according to claim 1, wherein the cutting notches (6) of the counterpart blade cutting edge (4) have a wedge angle (δ) of between 45° and 90°, and the at least one helically coiled blade cutting edge (5) has a wedge angle (β) of between 10° and 90°.

13. The shearing device (1) according to claim 1, wherein the at least one helically coiled blade cutting edge (5) is arranged on a web (16) which runs in helically coiled fashion around the axis of rotation (R) of the blade (2), and the web (16) has a web width of 0.3 mm to 5 mm and a web height of 1 mm to 20 mm.

14. The shearing device (1) according to claim 1, wherein cutting notches (6) of the counterpart blade (3) have a profile direction which is oriented at right angles or obliquely with respect to a main extent direction of the counterpart blade cutting edge (4).

15. The shearing device (1) according to claim 1, further comprising a holder (19) for a workpiece (8).

16. A shearing device (1), comprising:

a blade (2) having at least one blade cutting edge (5);

a counterpart blade (3) assigned to the blade (2);

the blade (2) is rotatable about an axis of rotation (R) in order to generate a cutting movement relative to a fixed counterpart blade cutting edge (4) of the counterpart blade (3);

the at least one blade cutting edge (5) is helically coiled about the axis of rotation (R);

the fixed counterpart blade cutting edge (4) includes cutting notches (6) to form a notched counterpart blade cutting edge; and the cutting notches (6) in the counterpart blade (3) have an acute opening angle.

17. A shearing device (1), comprising:

a blade (2) having at least one blade cutting edge (5);

a counterpart blade (3) assigned to the blade (2);

the blade (2) is rotatable about an axis of rotation (R) in order to generate a cutting movement relative to a fixed counterpart blade cutting edge (4) of the counterpart blade (3);

the at least one blade cutting edge (5) is helically coiled about the axis of rotation (R);

the fixed counterpart blade cutting edge (4) includes cutting notches (6) to form a notched counterpart blade cutting edge; and the at least one helically coiled blade cutting edge (5) has a clearance angle (λ) of between 1° and 30°, and the counterpart blade (3) has an acute or an obtuse bevel angle (α) which is enclosed between a bevel (14) adjoining the counterpart blade cutting edge (4) and a longitudinal plane of the counterpart blade (3).

18. A shearing device (1), comprising:

a blade (2) having at least one blade cutting edge (5);

a counterpart blade (3) assigned to the blade (2);

the blade (2) is rotatable about an axis of rotation (R) in order to generate a cutting movement relative to a fixed counterpart blade cutting edge (4) of the counterpart blade (3);

the at least one blade cutting edge (5) is helically coiled about the axis of rotation (R);

the fixed counterpart blade cutting edge (4) includes cutting notches (6) to form a notched counterpart blade cutting edge;

a wedge angle (δ) of the notches (6) of the counterpart blade cutting edge (4) is greater than or equal to a bevel angle (a) of the counterpart blade (3) which is enclosed between a bevel (14) adjoining the counterpart blade cutting edge (4) and a longitudinal plane of the counterpart blade (3).

19. A shearing device (1), comprising:

a blade (2) having at least one blade cutting edge (5);

a counterpart blade (3) assigned to the blade (2);

the blade (2) is rotatable about an axis of rotation (R) in order to generate a cutting movement relative to a fixed counterpart blade cutting edge (4) of the counterpart blade (3);

the at least one blade cutting edge (5) is helically coiled about the axis of rotation (R);

the fixed counterpart blade cutting edge (4) includes cutting notches (6) to form a notched counterpart blade cutting edge; and the blade (2) has, between the at least one helically coiled blade cutting edge (5) and a flank (17) of the blade cutting edge (5), a transition surface (18) which is parallel to the axis of rotation (R) of the blade (2) and has a width, measurable in a direction of the axis of rotation (R), of between 0.001 mm and 0.3 mm.

20. A shearing device (1), comprising:

a blade (2) having at least one blade cutting edge (5);

a counterpart blade (3) assigned to the blade (2);

the blade (2) is rotatable about an axis of rotation (R) in order to generate a cutting movement relative to a fixed counterpart blade cutting edge (4) of the counterpart blade (3);

the at least one blade cutting edge (5) is helically coiled about the axis of rotation (R);

the fixed counterpart blade cutting edge (4) includes cutting notches (6) to form a notched counterpart blade cutting edge; and a multi-axis robot (20) for at least one of: handling a workpiece (8), feed of the workpiece, or manipulation of the workpiece (8) at the blade (2).

21. A shearing device (1), comprising:

a blade (2) having at least one blade cutting edge (5);

a counterpart blade (3) assigned to the blade (2);

the blade (2) is rotatable about an axis of rotation (R) in order to generate a cutting movement relative to a fixed counterpart blade cutting edge (4) of the counterpart blade (3);

the at least one blade cutting edge (5) is helically coiled about the axis of rotation (R);

the fixed counterpart blade cutting edge (4) includes cutting notches (6) to form a notched counterpart blade cutting edge; and a multi-axis robot (20) on which at least one of the blade (2) or the counterpart blade (3) are arranged.

22. A shearing device (1), comprising:

a blade (2) having at least one blade cutting edge (5);

a counterpart blade (3) assigned to the blade (2);

the blade (2) is rotatable about an axis of rotation (R) in order to generate a cutting movement relative to a fixed counterpart blade cutting edge (4) of the counterpart blade (3);

the at least one blade cutting edge (5) is helically coiled about the axis of rotation (R);

the fixed counterpart blade cutting edge (4) includes cutting notches (6) to form a notched counterpart blade cutting edge; and a bristle displacement device (21).

23. A brush production machine (22) comprising a shearing device (1) including:

a blade (2) having at least one blade cutting edge (5);

a counterpart blade (3) assigned to the blade (2);

the blade (2) is rotatable about an axis of rotation (R) in order to generate a cutting movement relative to a fixed counterpart blade cutting edge (4) of the counterpart blade (3);

the at least one blade cutting edge (5) is helically coiled about the axis of rotation (R);

the fixed counterpart blade cutting edge (4) includes cutting notches (6) to form a notched counterpart blade cutting edge.

24. A method of shearing bristle filaments to length, comprising:

feeding bristle filaments to the shearing device (1) including a blade (2) having at least one blade cutting edge (5), a counterpart blade (3) assigned to the blade (2), the blade (2) being rotatable about an axis of rotation (R) in order to generate a cutting movement relative to a fixed counterpart blade cutting edge (4) of the counterpart blade (3), the at least one blade cutting edge (5) being helically coiled about the axis of rotation (R), and the fixed counterpart blade cutting edge (4) including cutting notches (6) to form a notched counterpart blade cutting edge; and cutting the bristle filaments (7) to length.

* * * * *